US009051106B2

(12) United States Patent
Milano

(10) Patent No.: US 9,051,106 B2
(45) Date of Patent: Jun. 9, 2015

(54) PACKAGE FOR TOUCH-SENSITIVE FOODSTUFF PRODUCTS

(75) Inventor: Giuseppe Milano, Alba (IT)

(73) Assignee: SOREMARTEC S.A., Findel (LU)

( * ) Notice: Subject to any disclaimer, the term of this patent is extended or adjusted under 35 U.S.C. 154(b) by 1645 days.

(21) Appl. No.: 11/917,623

(22) PCT Filed: Jun. 8, 2006

(86) PCT No.: PCT/IB2006/001692

§ 371 (c)(1),
(2), (4) Date: Dec. 14, 2007

(87) PCT Pub. No.: WO2007/007141

PCT Pub. Date: Jan. 18, 2007

(65) Prior Publication Data

US 2008/0199570 A1 Aug. 21, 2008

(30) Foreign Application Priority Data

Jul. 8, 2005 (IT) ..... TO2005A0471

(51) Int. Cl.

| | |
|---|---|
| ***B65D 43/02*** | (2006.01) |
| ***B65D 75/68*** | (2006.01) |
| ***B65B 11/50*** | (2006.01) |
| ***B65B 25/00*** | (2006.01) |
| ***B65D 77/20*** | (2006.01) |
| ***B65D 85/60*** | (2006.01) |

(52) U.S. Cl.

CPC ..... *B65D 75/68* (2013.01); *B65D 43/0222* (2013.01); *B65B 11/50* (2013.01); *B65B 25/005* (2013.01); *B65D 77/2024* (2013.01); *B65D 85/60* (2013.01)

(58) Field of Classification Search

CPC ..... B65D 43/0222
USPC ..... 220/266, 268, 270, 359.1, 359.4, 359.5, 220/608, 657, 287, DIG. 13, 359.2; 426/123, 106, 122, 395, 115

See application file for complete search history.

(56) References Cited

U.S. PATENT DOCUMENTS

| | | | | |
|---|---|---|---|---|
| 1,858,247 | A * | 5/1932 | Milliron et al. | 312/351 |
| 2,585,180 | A * | 2/1952 | Smith | 220/796 |
| 3,292,810 | A * | 12/1966 | Schechter | 220/4.24 |

(Continued)

FOREIGN PATENT DOCUMENTS

| | | |
|---|---|---|
| AU | 476870 B2 | 7/1974 |
| DE | 19747228 A1 | 5/1999 |

(Continued)

*Primary Examiner* — Steven A. Reynolds
*Assistant Examiner* — King M Chu
(74) *Attorney, Agent, or Firm* — Rothwell, Figg, Ernst & Manbeck, P.C.

(57) ABSTRACT

A package (1) for touch-sensitive foodstuff products (P), such as chocolates or pralines, comprises:—a tray-like container (2) made of elastically deformable material that is able to receive a first part of the product (P) and has a mouth edge (3) that surrounds the product (P), allowing a substantial part thereof to emerge therefrom; and—a film (4) made of a material that is tearable and deformable in a plastic way, shaped according to a general dome-like conformation so as to contain, in the absence of stresses, the aforesaid substantial part of the product (P) emerging from the mouth edge (3) of the tray-like container (3); the tray-like container (2) and the film (4) are connected to one another in conditions of hermetic seal at the mouth edge (3) of the tray-like container (2).

28 Claims, 4 Drawing Sheets

(56) References Cited

U.S. PATENT DOCUMENTS

| | | | | | |
|---|---|---|---|---|---|
| 3,861,433 | A | * | 1/1975 | Schier et al. | 220/782 |
| 3,866,820 | A | * | 2/1975 | Zumsteg | 229/120.05 |
| 3,874,548 | A | * | 4/1975 | Buff, Jr. | 220/507 |
| 3,997,677 | A | * | 12/1976 | Hirsch et al. | 426/113 |
| 4,430,134 | A | * | 2/1984 | Gras | 156/224 |
| 4,510,735 | A | | 4/1985 | Cillario | |
| 4,796,408 | A | * | 1/1989 | Mobark | 53/427 |
| 4,863,058 | A | * | 9/1989 | Antoni et al. | 220/675 |
| 5,605,646 | A | * | 2/1997 | Colombo et al. | 249/134 |
| 5,858,428 | A | * | 1/1999 | Truscello et al. | 426/115 |
| 6,135,304 | A | * | 10/2000 | Wyslotsky | 220/276 |
| 6,408,598 | B1 | * | 6/2002 | Stockley, III | 53/433 |
| 6,488,972 | B1 | | 12/2002 | Cerani | |
| 6,513,306 | B1 | * | 2/2003 | Milano | 53/453 |
| 7,282,532 | B2 | * | 10/2007 | Akbar et al. | 524/588 |
| 7,984,807 | B2 | * | 7/2011 | Elliott | 206/532 |
| 2001/0000480 | A1 | * | 4/2001 | Stagg et al. | 428/43 |
| 2002/0015764 | A1 | * | 2/2002 | Laffont et al. | 426/94 |
| 2003/0141218 | A1 | * | 7/2003 | Stephens et al. | 206/820 |
| 2003/0196412 | A1 | * | 10/2003 | Foulke, Jr. | 53/432 |
| 2008/0199570 | A1 | * | 8/2008 | Milano | 426/123 |
| 2010/0086652 | A1 | * | 4/2010 | Mansuino | 426/122 |

FOREIGN PATENT DOCUMENTS

| | | | |
|---|---|---|---|
| EP | 0591742 | A1 | 4/1994 |
| EP | 0790184 | A1 | 8/1997 |
| EP | 1046579 | A1 | 10/2000 |

* cited by examiner

PACKAGE FOR TOUCH-SENSITIVE FOODSTUFF PRODUCTS

CROSS REFERENCE TO RELATED APPLICATION

This application is a 35 U.S.C. §371 National Phase Entry Application from PCT/IB2006/001692, filed Jun. 8, 2006, and designating the United States. This application also claims the benefit of Italian Patent Application No. TO2005A000471 filed Jul. 8, 2005, the disclosure of which is incorporated herein in its entirety by reference.

FIELD OF THE INVENTION

The invention relates to packages for foodstuff products and has been developed with particular attention paid to its possible application to the packaging of touch-sensitive foodstuff products.

Representative of this type of foodstuff product are, for example, certain confectionery products, such as chocolates, pralines or the like. For these products the sensitivity to touch derives typically from the presence of a coating made of friable particulate material or a material that may detach from the surface of the product and/or of a coating made of soft material or a material that can be softened by even modest application of heat: this is typically the case of products provided with a coating of chocolate or similar material.

DESCRIPTION OF THE RELATED ART

The technique of packaging foodstuff products of the type described above goes back a long time, to well before the production on an industrial scale of said products was proposed and implemented.

A type of package that is still extensively used for confectionery products of a traditional type (and also for confectionery products produced on an industrial scale) envisages that the product is placed in a cup made of sheet-like material, typically paper. This is usually a cup shaped like a truncated cone with a pleated peripheral wall, known in the sector by the term "baking cup". The product is simply deposited in the container as "bare" product, i.e., without a coating of any sort.

For many products of a praline type there has then been a widespread adoption (possibly in combination with the use of a cup-shaped container of the type described previously) of the solution of wrapping the product in a sheet-like material, such as paper or aluminium. A solution that enables creation of a package of this sort on an industrial scale is described, for example, in U.S. Pat. No. 4,510,735 A.

Albeit enabling complete protection with respect to the outside of the surface of the product, this solution is not able to bestow upon the package as a whole characteristics of hermetic seal. These characteristics are particularly appreciated in the case of confectionery products produced on an industrial scale, for which it is important to guarantee a shelf life that is sufficiently long.

Solutions that move in the direction of bestowing upon wrappers of the type described above characteristics of hermetic seal form the subject of documents, such as, for example, EP-A-0 591 742, EP-A-0 790 184, or else EP-A-1 046 579.

The solutions described in the latter three cited documents basically envisage that the product is wrapped in a wrapper formed by two sheets sealed around the product and folded in a relationship of wrapping of the product itself. In particular, the solution described in EP-A-1 046 579 envisages that a part of the wrapper is subjected to shaping so as to reproduce approximately the appearance of a cup with a pleated wall that is to receive the product.

The above known solutions solve the problem of bestowing upon the wrapper characteristics of hermetic seal. However, they achieve this advantage only at the cost of a relative structural complexity (which results in a corresponding complexity and burdensomeness of the associated process of production) and at the cost of requiring in any case the use of a pleated cup-shaped container or else of reproducing the functional characteristics (and the characteristics of appearance) of such a container only to a partially satisfactory extent.

The fact of referring to the aesthetic appearance of the package has a certain importance in the applicational context to which reference is made herein. In the sector, there is in fact felt, to a non-negligible extent, the need to obtain a product (and above all the corresponding package) that does not reveal too evidently its basically industrial origin, but rather possibly recalls at least approximately the appearance of a home-made product and package.

In the course of the last few years, there has then developed the tendency to enable products of the type described above to be preserved and consumed even in rather hot climates; this, without involving any need to refrigerate the product and without the exposure to quite high temperatures resulting in a loss of the aesthetic and organoleptic quality thereof.

Traditional packages that envisage the practically complete wrapping of the product with a sheet-like material cannot be considered satisfactory in regard to this trend. This concerns both the handling of the product (which desirably should afford the possibly of being picked up and gripped without this involving any undesirable squashing and deformation of the product itself) and opening of the package in order to consume the product. The operation of opening the package must be simple and lead to uncovering the product in a practical and pleasant manner (without any risk of the product being inadvertently expelled from the package, getting squashed, or possibly smearing the package). In addition, it is important to prevent the risk of any undesirable contact with the hands of the consumer: in other words, it is desirable for the package to be openable and the product to be consumable without the consumer running the risk of dirtying his hands.

To complete this overview of the prior art, it may again be noted that the technique of packaging foodstuff products is an extensive sector, which covers, in addition to foodstuff products of the type described so far, also foodstuff products that are altogether different, such as, for example, poultry products, fish products, meat, vegetables, ice-cream, and products of various nature that are on sale, for example, in supermarkets and hypermarkets with presentation to the public at the frozen-food counter. Documents exemplifying the corresponding techniques of packaging are U.S. Pat. No. 6,488,972 and US-A-2003/0 196 412.

Irrespective of certain aspects of use and design that are certainly common to all of them, these packages are, in the vast majority of cases, designed to receive within them foodstuff products that are certainly not qualified as touch-sensitive products. These are in fact very frequently frozen foodstuffs, which are able to withstand mechanical stresses. In these packages extensive recourse is then had, for example, to techniques that envisage the use of plastic film materials that are stretched and/or thermoformed using the foodstuff product itself as element of reaction, which enables the process of stretching or thermoforming. Clearly, the use of such solutions is not conceivable in combination with foodstuff products that are touch-sensitive.

This applies also as regards the picking-up of the product, which more often than not is taken out of the package at home by the consumer when carrying out normal operations of cooking, and hence with the availability of a resting surface, a certain working space, and means for washing one's hands.

Furthermore, the use of these packages according to the known art leads to the fact that more often than not the visibility of the product is represented for the most part by the transparency of the package or of part of the package itself (typically, the stretched or thermoformed film), with the product that is accommodated for the most part within a tray-like body.

This mode of presentation, albeit technically feasible, is not acceptable for the foodstuff products referred to in the introductory part of the present description, the main reason for this being precisely the fact that this mode of presentation, adopted for the "supermarket" products just referred to, are not appreciated, for example, for the presentation of products such as confectionery products.

OBJECT AND SUMMARY OF THE PRESENT INVENTION

From the description of the prior art presented previously, it emerges that in making packages for touch-sensitive foodstuff products, in particular confectionery products and the like, it is necessary to take into account a wide range of requirements that emerge as being substantially in contrast with one another.

There then exists the need to provide a solution that is able to expres an ideal synthesis of elements of advantage with regard to the various solutions described previously.

The object of the present invention is to provide a solution of this type.

According to the present invention, that object is achieved thanks to a package having the characteristics recalled specifically in the claims that follow. The claims form an integral part of the disclosure provided herein in relation to the invention.

In the currently preferred embodiment, the package according to the invention comprises:

- a tray-like container made of elastically deformable material adapted to receive a first part of the product and having a mouth edge to surround the product, allowing a substantial part thereof to emerge therefrom;
- a film made of a material that is tearable and plastically deformable, shaped according to a general dome-like conformation so as to contain, in the absence of stress, said substantial part of product emerging from the mouth edge of the tray-like container, said tray-like container and said film being connected to one another in conditions of hermetic seal along the mouth edge of the tray-like container.

Further advantageous characteristics of the container according to the invention form the subject of the dependent claims.

BRIEF DESCRIPTION OF THE ANNEXED DRAWINGS

The invention will now be described, purely by way of non-limiting example, with reference to the annexed plate of drawings, in which.

DETAILED DESCRIPTION OF PREFERRED EXEMPLARY EMBODIMENTS OF THE INVENTION

The ensuing detailed description refers to the fabrication of a package that is to receive within it a foodstuff product P, comprised, for example of a praline having a spherical shape, possibly with flattened base. This may be, by way of example (and without this in any way limiting the scope of the invention), the praline that has been sold for many years under the trademark Ferrero Rocher® by the company of the Ferrero group. This is a product formed by a spherical shell of wafer filled with cream and having an outer coating formed by a layer of chocolate containing within it ground hazelnuts.

The package 1 of the product P is basically made up of two elements, namely:

- a tray-like container 2 made of elastically deformable material, which receives within it a first part (i.e., a sort of "bottom" part) of the product and has a mouth edge 3, which surrounds the product P, allowing a substantial part thereof to emerge therefrom; and
- a film 4 made of a material that is tearable and plastically deformable, shaped according to a general dome-like conformation so as to contain, in the absence of stress, the part of product P that emerges from the mouth edge 3 of the tray-like container 2.

The tray-like container 2 and the film 4 are welded to one another in conditions of hermetic seal at the mouth edge 3 of the tray-like container 2.

Figure 1:
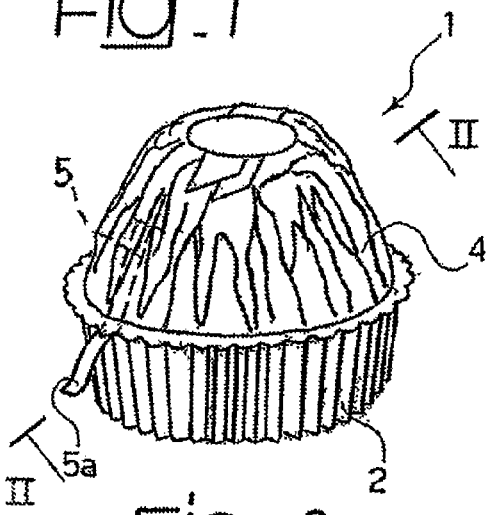
FIG. 1 is a general perspective view of a package of foodstuff product of the type described herein.

The tray-like container 2 preferentially has an overall truncated-cone shape (except for the bottom part in relief, which will be described in greater detail in what follows), with a profile diverging in the direction of the product P. In a preferred way, the tray-like container 2 has a peripheral wall or skirt having a pleated pattern. Viewed from outside (see, in particular, the perspective view of FIG. 1), the container 2 has then an appearance that substantially resembles that of the paper cup with pleated wall, referred to in the introductory part of the present description.

The tray-like container 2 is obtained by thermoforming or injection of a plastic material such as, for example, polyvinyl chloride (PVC), polyethylene terephthalate (PET), polypropylene (PP), polystyrene (PS) or by resorting to combinations of these materials. This is then an elastically deformable material, in the sense that the tray-like container 2 has a shape of its own that it may assume (and re-assume) spontaneously in the absence of stresses from outside.

This means that, when the package 1 is picked up, by gripping it in a position corresponding to the container 2, the same container demonstrates a certain resistance to deformation and hence a certain mechanical consistency.

In a preferred (albeit not imperative) way, the radial dimensions of the container 2 are chosen (see, in particular, the cross-sectional view of FIG. 2) so as to receive the product P with a certain tolerance. In other words, the container 2 leaves in any case a certain amount of empty space around the product P, hence preventing the wall of the product P (which is in general touch-sensitive) from being in conditions of extensive contact with the internal surface of the wall of the container 2. This effect of "separation" is rendered even more marked by the pleated pattern of the wall or skirt of the container 2: this pleated pattern means that, even when the product P is resting on the peripheral wall of the container 2, contact is in effect limited only to the top areas of the pleated pattern and does not extend continuously over the entire surface of side wall of the cup-shaped container 2.

The height of the peripheral wall of the tray-like container 2 is chosen in relation to the overall height of the product P (designated as a whole by h in FIG. 2) in such a way as to cause the tray-like container 2 to receive within it a first part of the product P, allowing, however, a substantial part of the product P itself to emerge beyond the mouth edge 3 of the tray-like container.

The expression "substantial part" is here meant to indicate a portion, which, preferentially, corresponds to not less than 40%, typically at least 50%, and in a particularly preferred way represents approximately 60% of the overall height h of the product P.

In a particularly preferred embodiment, the tray-like container 2 is made of metallized material (for example, with a treatment of aluminization) in such a way as to present characteristics that enable reflection of light towards the outside of the package 1. In addition to attributing to the container 2 a particularly pleasant aesthetic appearance, this characteristic proves advantageous in so far as it bestows upon the tray-like container 2 characteristics of thermal insulation.

In the currently preferred embodiment, the mouth edge 3 of the tray-like container 2 assumes the characteristics of an annular flange (with an indented external profile in the case where the container 2 presents a pleated peripheral wall).

The fact of making the mouth edge in the form of a flange of this type has (in addition to advantages during connection to the film 4, as will be explained more fully in what follows) further elements of advantage linked to the fact that the aforesaid flange constitutes a formation for stiffening the mouth edge 3 of the tray-like container. In addition to this, by projecting radially outwards, the flange 3 constitutes a formation for preferential gripping of the package. The consumer is thus facilitated and in effect invited to take hold of the package 1 by gripping the flange 3 between the thumb and one of the other fingers of the hand in conditions such that the regions of the outer edge of the flange in which the consumer's fingers rest on the package 1 are set at a distance from the outer wall of the product P. In this way, an undesirable phenomenon of heating of the product P by the fingers of the consumer who takes hold of the package is avoided.

The film 4 is formed, as already mentioned previously, of a material that is deformable in a plastic way. In other words, this means that the film in question is made of a material that, when deformed, preserves the deformed shape, without any appreciable elastic return.

This characteristic is important in so far as it means that, since the film 4 is shaped according to a general dome-like conformation, it is able to contain the product P, wrapping it, without applying appreciable tensile or compressive stresses on the product P. This is in contrast with solutions, such as the "supermarket" packages referred to in the introductory part of the present description, which envisage, instead, the use of a stretched or thermoformed film using the product P as element of contrast during stretching or thermoforming. It is hence evident that, in these solutions according to the known art, the product P is subjected to appreciable compressive and tensile stresses, which would be intolerable for a touch-sensitive foodstuff product.

In addition to this, the film 4 is made so that it can be conveniently torn.

For this purpose, according to a particularly preferred embodiment of the invention, it is envisaged that the film 4 carries associated to it, according to a diametral and polar path with respect to its general dome-like development, a tear strip 5 made of plastic material. The tear strip 5 has a first end 5*a*, which projects at least slightly on the outside of the package so as to enable it to be gripped easily by the user, and a second end 5*b*, located in a diametrally opposite position, anchored to a point of the line of sealed welding between the film 4 and the mouth edge 3 of the tray-like container 2.

Figure 3:
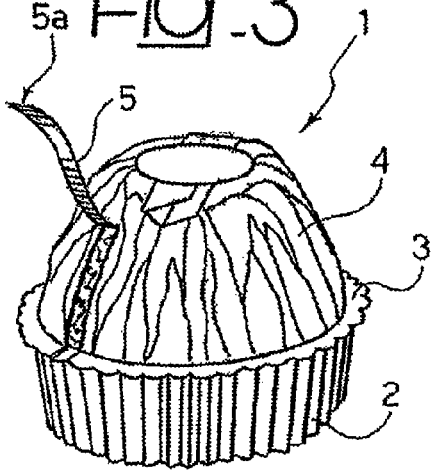
FIGS. 3 to 5 are schematically representative of the modalities of opening the package according to the invention.
Figure 4:
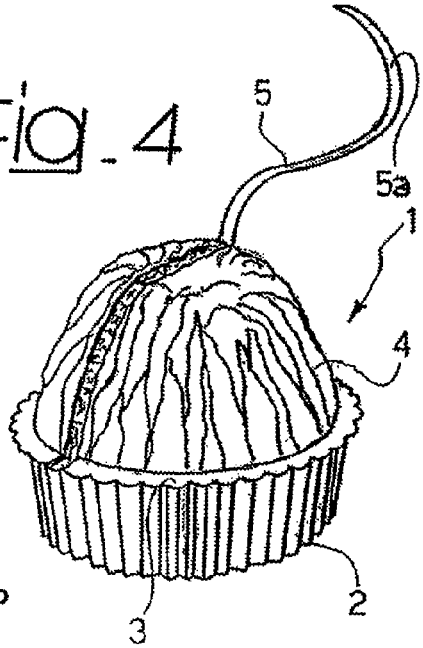
Figure 5:
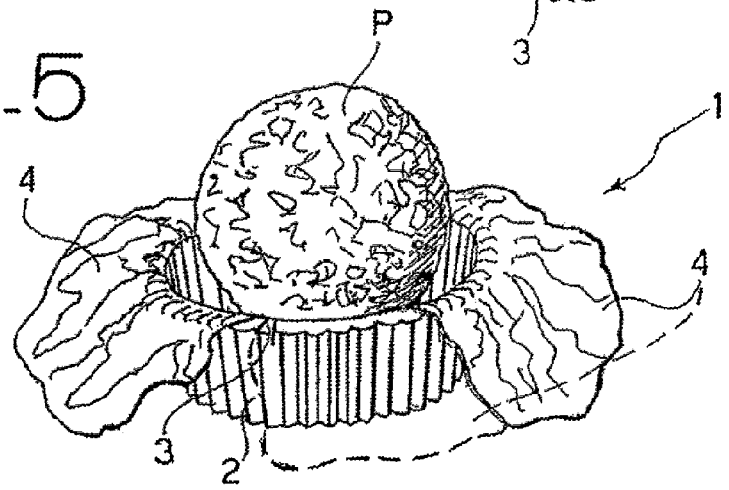

As schematically illustrated in the sequence of FIGS. 3 to 5, the user can then grip the tear strip 5 in a position corresponding to the end 5*a* to pull it away from the mouth edge 3 of the tray-like container 2 so as to bring about tearing of the film 4 along a diametral plane of the general dome-like conformation thereof.

As will be better appreciated with reference to the sequence of FIGS. 4 and 5, the top part of the package is thus divided into two complementary parts (each approximately resembling a semi-dome), which may be conveniently divaricated with respect to the product P so as to uncover the product and to enable it be held conveniently between the consumer's lips and thus taken to his or her mouth.

According to said particular mode of consumption, of considerable importance is the fact that a substantial part of the product P emerges freely beyond the mouth edge 3 of the tray-like body. Once the dome of the film 4 has been torn, this substantial part can in fact be conveniently held by the lips with an action of firm gripping, which prevents any risk of the product undesirably dropping and possibly dirtying the user's fingers.

The film 4 can be made of materials of different types. Particular attention is usually paid to the fact that the material in question must preferably be impermeable to water (or water vapour), oxygen and aromas.

A currently particularly preferred choice is that of envisaging the film 4 being made of a film with a base of metal material such as aluminium. This is in a particularly preferred way a so-called "coupled" film, formed by an outer layer of aluminium with a thickness in the region of 8-25 micron, having on the surface that faces the inside of the package 1, a coating made of heat-meltable material, such as polythene.

A material of this kind has excellent qualities of heat-sealablity with the material constituting the tray-like container 2 in conditions of hermetic seal. Of course, the heat-sealing of the film with the mouth edge 3 of the tray-like container 2 constitutes just one of the possible options for the production of the package described herein. An alternative solution (at least for the moment less preferred) is the one that envisages gluing. Yet another alternative is constituted by ultrasound welding.

The mouth edge 3 of the tray-like body 2, formed (in the currently preferred embodiment) by an annular flange projecting towards the outside of the tray-like body 2 for a radial dimension in the region of 0.5-1.5 mm gives rise to an ample surface of resting/welding with the possibility of providing a high degree of hermetic seal as a result of the thermal melting of the heat-meltable layer of the "coupled" material with the material constituting the tray-like container 2.

Figure 2:
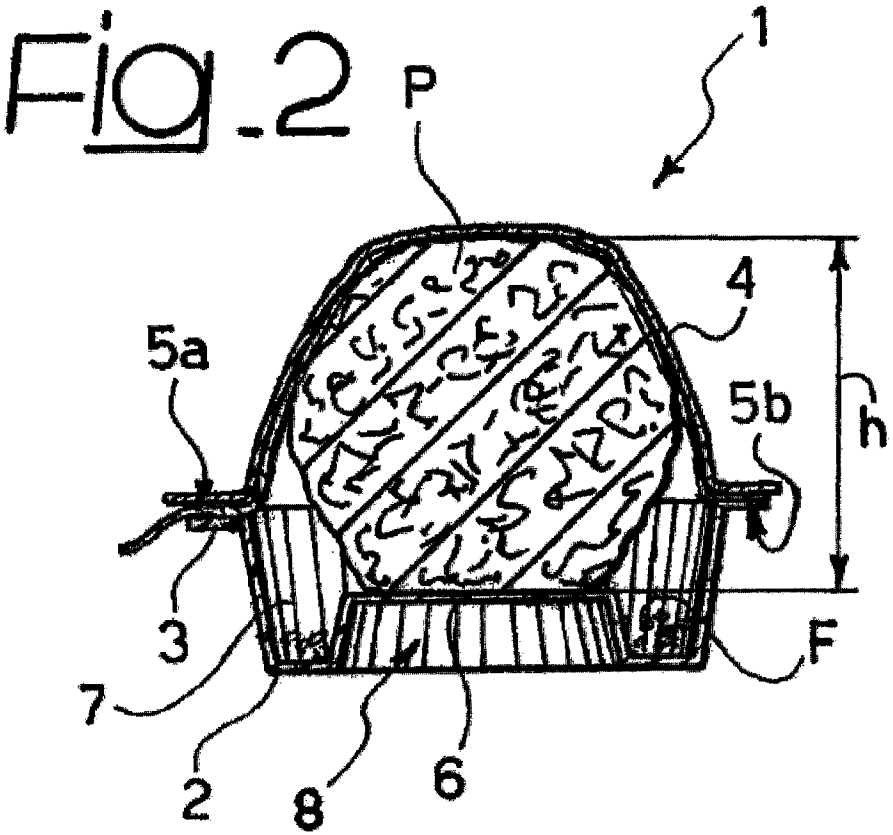
FIG. 2 is a cross section of the package represented in FIG. 1 according to the line II-II of FIG. 1.

As may be appreciated in the cross-sectional view of FIG. 2, the body 2 in question preferentially has a base wall, which, instead of being as a whole plane, has a central portion in relief designated as a whole by 6. This portion in relief, which roughly resembles an embossing, can be made as a moulding cavity, and in a preferred way is constituted by a moulding cavity that opens towards the outside of the tray-like body 2.

The presence of the portion in relief 6 (which typically has a height in the region of 30-40% of the overall height of the side wall or skirt of the tray-like body 2) affords various advantages.

In the first place, the portion in relief 6 (which is usually formed in a position centred with respect to the base part of the tray-like body 2) defines, along its outer contour, a sort of annular channel 7 that is able to receive and contain possible fragments F that may detach from the product P.

Figure 12:
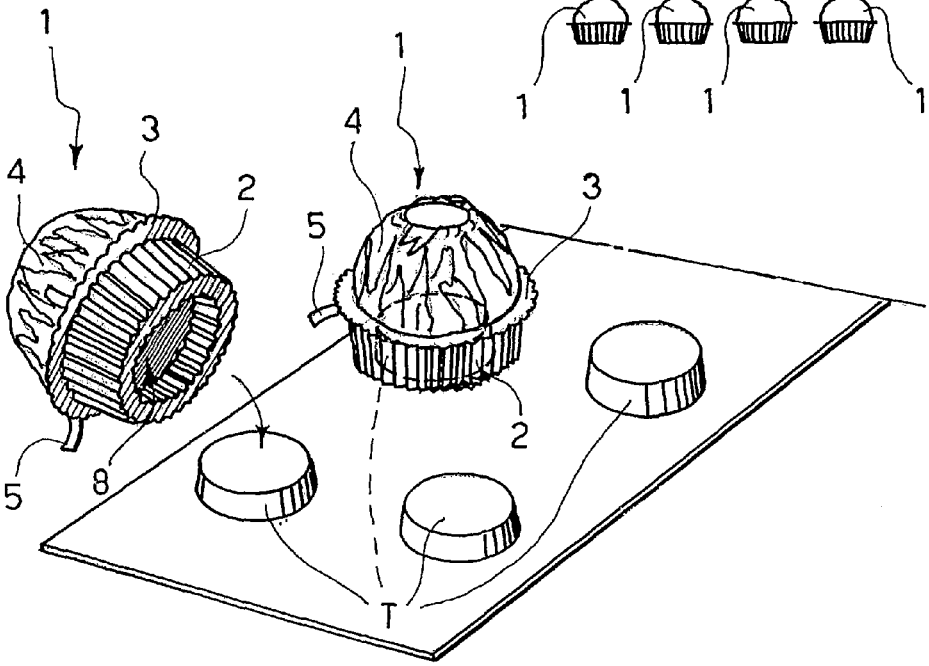

In the second place (and in a complementary way), the cavity 8 that the portion in relief 6 defines towards the outside of the package 1 constitutes a cavity that is able to receive a respective tenon-like formation made on the bottom of a container (for example, a box) that is to receive within it a plurality of packages 1 of the type just described, as schematically illustrated in FIG. 12, to which more extensive reference will be made in what follows.

From the foregoing description, there emerges, as a fact of considerable importance, the extreme structural simplicity of the package 1 just described. This structural simplicity results in a corresponding simplification (and hence in a greater efficiency in terms of rapidity and reduction in costs) of the respective process of fabrication, schematically represented in FIGS. 6 to 12.

Figure 6:
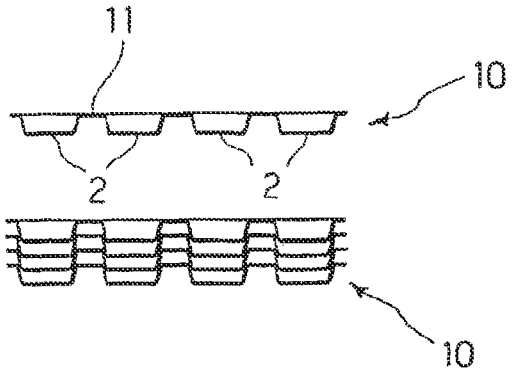
FIGS. 6 to 12 are schematic illustrations of various steps of the process that leads to the production of the package described herein.
Figure 7:
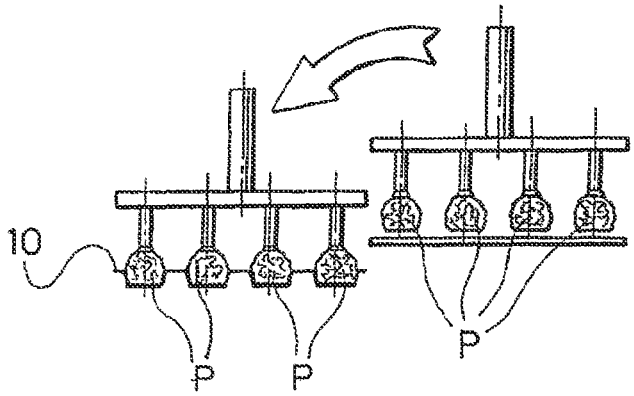

Of the above figures, FIG. 6 illustrates schematically the pre-arrangement of tray-like elements 10 that can be virtually seen as being formed by a regular and plane array of tray-like containers 2 connected to one another by a plane core wall 11.

The tray-like containers 10 are to receive within them arrays of products P. This operation of filling, schematically illustrated in FIG. 7, can be carried out with known techniques, for example with manipulating devices that are widely used in the confectionery industry.

A subsequent step of the process of production is the formation, starting from a clear film made of a material that is tearable and plastically deformable, of a corresponding array of dome-like elements 13, each of which is to coat the top part of a respective product P.

Figure 8:
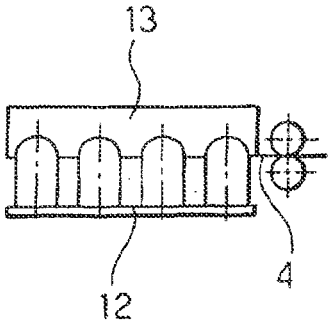
Figure 9:
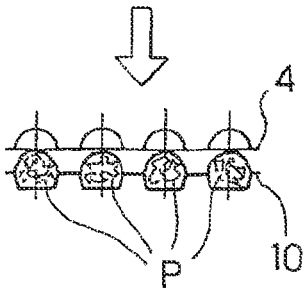

FIG. 8 illustrates schematically the operation of formation of the dome-like parts of the film 4, obtained by operating with an ensemble formed by a mould 12 and a countermould 13. FIG. 9 illustrates, instead, the subsequent application of said dome-like parts on the array of the products P received within the trays 10.

Figure 10:
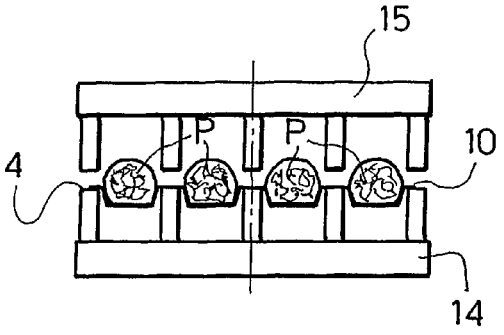

FIG. 10 illustrates schematically the operation with which the various dome-like elements of the film 4 are hermetically sealed (for example, by heat-sealing) along the homologous portions of the mouth edges of the alveoli formed in the trays 10. Also this operation of heat-sealing is obtained using techniques (for example, with the use of complementary elements 14 and 15, which move with respect to one another with a relative jaw-like motion) that are known in the industry of packaging of foodstuff products, in particular in the confectionery sector.

Figure 11:
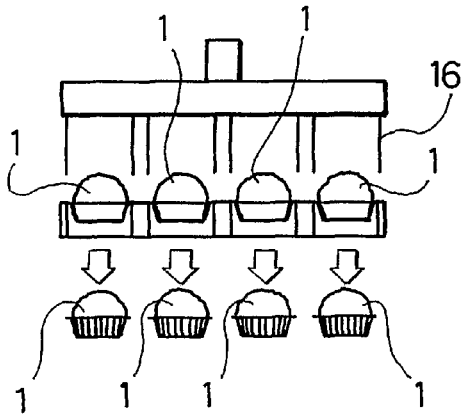

FIG. 11 illustrates then the complex of operations that causes the packages 1, produced in arrays, to be separated from one another, to give rise to individual packages 1. This complex of operations involves in particular:

- cutting of the contour of the mouth parts 3 of the individual package 1, where said mouth parts (having the preferentially indented pattern) are welded with the peripheral edges of the domes of film 4, said operation being performed using drinking tools 16, of a known type; and
- expulsion of the individual packages 1 that contain the products P.

The packages 1 can then be inserted into containers of a traditional type, for example box-like ones, with a bottom wall provided with alveolar formations, each of which is to receive a package 1.

FIG. 12 refers, instead, to a solution in which the container for receiving the packages 1 has a bottom wall, provided with an array of tenon-like elements T projecting upwards, each of which is to engage the bottom cavity 8 of a respective package, keeping it in a fixed position within a regular and orderly array.

It will be appreciated that the overall cylindrical shape (or, more precisely that of a truncated cone) of the slot 8 and, in a complementary way, of the tenon-like formations T, is provided purely by way of example. Without any detriment to the function of positioning the packages 1, the slots 8 and the tenon-like formations T that are to engage them can assume complementary shapes that are altogether different, for example intersecting ones.

Of course, without prejudice to the principle of the invention, the details of construction and the embodiments may vary widely with respect to what is described and illustrated herein, without thereby departing from the scope of the present invention, as defined by the annexed claims.

The invention claimed is:

1. A sealed package for a touch-sensitive confectionary product, the package comprising:

a container made of elastically deformable material adapted to receive a first part of the touch-sensitive confectionary product and having a mouth edge to surround the touch-sensitive confectionary product, allowing a substantial part thereof to emerge therefrom;

a film made of a material that is deformable in a plastic way and tearable, shaped so as to contain, in the absence of tensile or compressive stresses on the product, said substantial part of the product emerging from the mouth edge of the container, wherein the film is formed by a coupled laminar comprising (i) an outer layer with a thickness greater than or equal to 8 micron and less than or equal to 25 micron and (ii) a coating made of a heat-meltable material on a surface of the outer layer that faces inside the package; and the touch-sensitive confectionary product surrounded by the mouth edge of the container, having the first part received in the container, and having the substantial part emerging from the mouth edge of the container and contained by the film in the absence of tensile or compressive stresses on the product;

wherein said container and said film are connected to one another in conditions of hermetic seal at the mouth edge of the container.

2. The package according to claim 1, wherein said container has a general pattern having the form of a truncated cone.

3. The package according to claim 1, wherein said container has a pleated peripheral wall.

4. The package according to claim 1, wherein said container is made of a thermoformed or injection-moulded plastic material.

5. The package according to claim 1, wherein said container is formed by a material chosen from the group made up of polyvinyl chloride (PVC), polyethylene terephthalate (PET), polypropylene (PP), polystyrene (PS), and combinations of these materials.

6. The package according to claim 1, wherein said container is provided with a metallization with a reflecting capacity towards the outside of the package.

7. The package according to claim 6, wherein said metallization is an aluminization.

8. The package according to claim 1, wherein said container has an annular flange defining said mouth edge.

9. The package according to claim 8, wherein said annular flange has an indented pattern.

10. The package according to claim 1, wherein said substantial part of product represents at least 40% of the overall height of the product.

11. The package according to claim 1, wherein said substantial part of product represents at least 50% of the overall height of the product.

12. The package according to claim 1, wherein said substantial part of product represents approximately 60% of the overall height of the product.

13. The package according to claim 1, wherein said film is a film with a base of metal material.

14. The package according to claim 13, wherein said metal material is aluminium.

15. The package according to claim 1, wherein said coating of the coupled laminar is weldable with the material constituting said container.

16. The package according to claim 1, wherein the outer layer is a layer of aluminum, the coating is polyethene, and said coupled laminar is an aluminium-polyethene coupled material.

17. The package according to claim 1, wherein said film is a film impermeable to water, water vapour, oxygen, and aromas.

18. The package according to claim 1, wherein said container and said film are connected to one another in a condition of hermetic seal via heat-sealing.

19. The package according to claim 1, wherein said container and said film are connected to one another in a condition of hermetic seal via gluing.

20. The package according to claim 1, wherein said container and said film are connected to one another in a condition of hermetic seal via ultrasound welding.

21. The package according to claim 1, wherein associated to said film is a tear strip.

22. The package according to claim 21, wherein said tear strip extends according to a substantially diametral path with respect to said film.

23. The package according to claim 21, wherein said tear strip has a first end welded to said mouth edge of said container and a diametrally opposite end that projects on the outside of the package in a position set between said container and said film.

24. The package according to claim 1, wherein said container has a bottom part in relief that keeps said product in a raised position.

25. The package according to claim 1, wherein said container has a bottom wall with a channel for collecting fragments that detach from said product.

26. The package according to 24, wherein said channel extends around said bottom wall in relief.

27. The package according to claim 1, wherein said container has a bottom wall provided on the outside with a cavity capable of engaging with an upwardly projecting element.

28. The package according to claim 1, wherein the elastically deformable material of the container is a different material than the material of the film.

* * * * *